United States Patent [19]

Uehara

[11] Patent Number: 4,840,368

[45] Date of Patent: Jun. 20, 1989

[54] BILL CONTAINING BOX APPARATUS OF BILL RECEIVING AND DISPENSING MACHINE

[75] Inventor: Kazuhiro Uehara, Tokyo, Japan

[73] Assignee: Laurel Bank Machines Co., Ltd., Tokyo, Japan

[21] Appl. No.: 111,277

[22] Filed: Oct. 22, 1987

[30] Foreign Application Priority Data

Oct. 31, 1986 [JP] Japan ..... 61-167583[U]

[51] Int. Cl.[4] ..... B65H 1/00

[52] U.S. Cl. ..... 271/162; 271/165; 271/157; 209/534; 232/1 D

[58] Field of Search ..... 271/162, 165, 149, 160, 271/157, 126, 145; 209/534, 909; 194/206, 207; 232/1 D, 43.2; 312/333, 327; 235/379; 109/24.1, 49, 47, 45

[56] References Cited

U.S. PATENT DOCUMENTS

| | | | |
|---|---|---|---|
| 2,785,036 | 3/1957 | Elsden-King et al. | 312/327 |
| 4,251,010 | 2/1981 | Schmeykal et al. | 209/534 X |
| 4,365,700 | 12/1982 | Arimoto et al. | 194/206 |
| 4,552,351 | 11/1985 | Tsukamoto | 271/3.1 |
| 4,709,914 | 12/1987 | Taylor | 209/534 X |
| 4,726,474 | 2/1988 | Arikawa et al. | 209/534 |

FOREIGN PATENT DOCUMENTS

| | | |
|---|---|---|
| 3736263 | 10/1987 | Fed. Rep. of Germany . |
| 58-39392 | 3/1983 | Japan . |
| 60-59492 | 4/1985 | Japan . |
| 60-67334 | 4/1985 | Japan . |
| 60-78332 | 5/1985 | Japan . |
| 60-100283 | 6/1985 | Japan . |
| 60-251487 | 12/1985 | Japan . |
| 61-18087 | 1/1986 | Japan . |

*Primary Examiner*—Joseph J. Rolla
*Assistant Examiner*—Steven Parker
*Attorney, Agent, or Firm*—Fleit, Jacobson, Cohn, Price, Holman & Stern

[57] ABSTRACT

A bill containing box apparatus used in a bill receiving and dispensing machine having a dispensation bill containing box mounted on the front of the machine body in an inclined condition for improving the handling of bills contained within the machine body. The dispensation bill containing box detachably mounted on the frame members in an inclined condition with the engaging members of the box snapped into the upper and lower notches formed in the frame members. The dispensation bill containing box can be tilted forward with the front door opened and the engaging members of the box disengaged from the upper notches for loading bills into the box or taking them out from the box. The dispensation bill containing box can be also separated from the frame members with the engaging members of the box disengaged from both the upper and lower notches of the frame members. This makes it possible to carry the box to any place for loading or removal of the bills. Since the bills contained in the box are stacked in an inclined condition, they tend to be obliquely pushed out from the box by gravity and are fed to the dispensation bill feeding-out apparatus through the bottom opening of the box.

5 Claims, 4 Drawing Sheets

BILL CONTAINING BOX APPARATUS OF BILL RECEIVING AND DISPENSING MACHINE

BACKGROUND OF THE INVENTION

The present invention relates to a so-called "circulation type" bill receiving and dispensing machine for containing received bills and dispensing bills, and more particularly to a bill containing box apparatus used in the bill receiving and dispensing machine having a dispensation bill containing box mounted on the front of the machine body in an inclined condition for improving the handling of bills contained within the machine body.

In general, the circulation type bill receiving and dispensing machine is required to efficiently carry out the bill receiving and dispensing operations and to improve the handling of bills contained within the machine body.

For example, such a circulation type bill receiving and dispensing machine is disclosed in Japanese laid-open patent publication No.059492/1985. The bill receiving and dispensing machine of this prior art is provided with a front door and a horizontally drawable bill containing box positioned behind the front door to improve the handling of bills. However, in the bill receiving and dispensing machine of the prior art, since the bill containing box of the drawer type must be fully drawn out from the machine body each time the machine is charged with bills or to remove accumulated bills at the start and finish of work each day, with additional bill charging operations during working hours, the work efficiency is markedly lowered.

SUMMARY OF THE INVENTION

It is an object of the present invention to provide a novel bill receiving and dispensing machine in which the bill containing box is mounted in an inclined condition within the machine body at the front thereof for easily carrying out the inspection and charging of bills merely by tilting the box toward the front of the machine body and which is also easily detached from the machine body.

According to the present invention, there is provided a bill containing box apparatus of a bill receiving and dispensing machine which is so adapted that bills inserted into a bill port are relayed to a bill discriminating path and the bills discriminated as genuine are accepted into the bill receiving and dispensing machine, said apparatus being provided with a dispensing bill containing box within the machine body in the vicinity of a front door of the machine body, the bill containing box apparatus comprising frame members spaced apart from each other at the right and left sides of the machine body in the vicinity of the front of the machine body, a pair of lower notches facing upward and a pair of upper notches facing to the front of the machine body, each pair of notches being formed in the frame members, and a dispensation bill containing box having an upper opening for insertion and removal of the bills therefrom and a bottom opening communicating with a dispensation bill feeding-out apparatus and being detachably engaged with the lower and upper notches via engaging members mounted on the sides of the box, the dispensation bill containing box being usually held within the machine body in a condition whereby the bottom opening is positioned at an obliquely lower position relative to the upper opening so as to contain the bills in an inclined stacked condition within the box.

Bills that are received are transferred to the bill discriminating path to discriminate that the bills are genuine. The bills discriminated as genuine are contained in the dispensation bill containing box. The dispensation bill containing box is detachably mounted on the frame members in an inclined condition with the engaging members of the box snapped into the upper and lower notches formed in the frame members. The dispensation bill containing box can be tilted forward with the front door opened and the engaging members of the box disengaged from the upper notches for filling the box with bills or removing bills from the box. The dispensation bill containing box can be also separated from the frame members with the engaging members of the box disengaged from both the upper and lower notches of the frame members. This makes it possible to carry the box to any suitable place for charging or removal of bills. According to the present invention, since the bills contained in the box are stacked in an inclined condition, they tend to be obliquely urged out from the box by the force of gravity and are fed to the dispensation bill feeding-out apparatus through the bottom opening of the box.

BRIEF DESCRIPTION OF THE INVENTION

Other objects and advantages of the present invention will become apparent from the following detailed description of a preferred embodiment of the present invention made with reference to the accompanying drawings in which.

Figure 4:
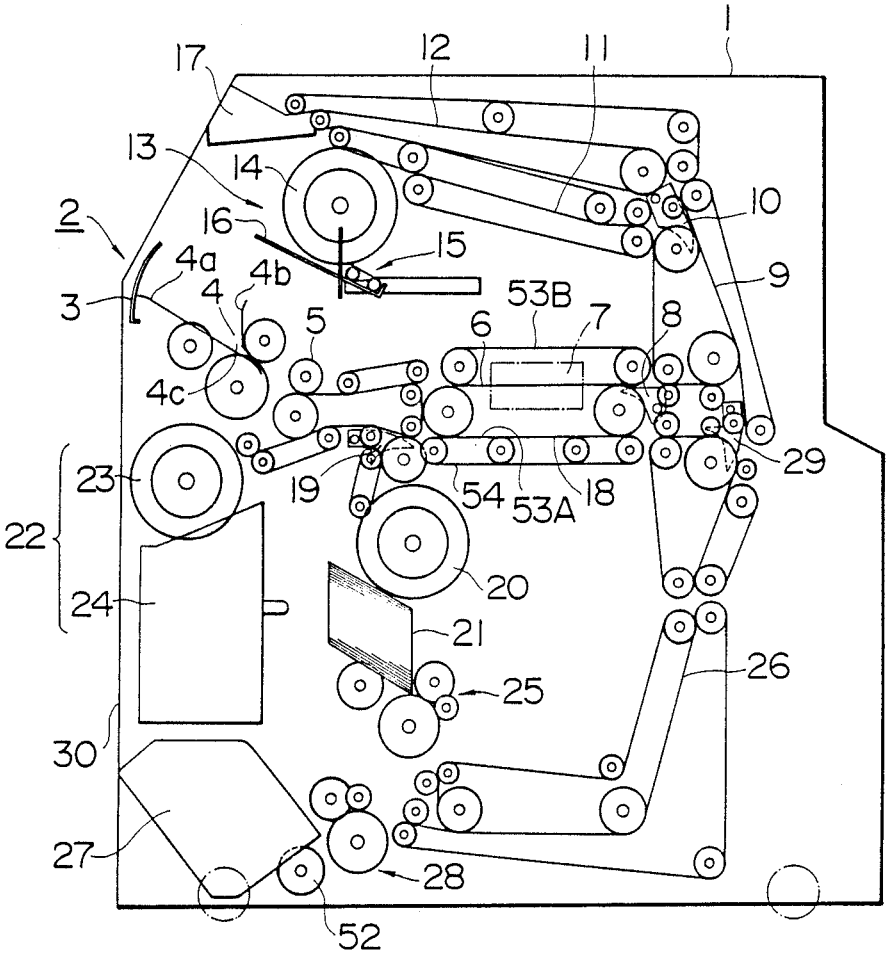
FIG. 4 is a side elevational view showing the general construction of the bill receiving and dispensing machine.

First, the general arrangement of the bill receiving and dispensing machine in which the dispensation bill containing box of the present invention is incorporated will be described with reference to FIG. 4. Of the various denominations of bills received, the bill receiving and dispensing machine shown in this embodiment is designed for circulation and reuse for dispensation of only 10,000 yen bills.

When a person selects the bill reception designation, a shutter 3 of a bill port 2 mounted on a machine body 1 is opened to expose a bill receiving and dispensing port 4. When bills are inserted into the bill port 2, the received bills are transferred by a received-bill feed apparatus 5 to a discriminating section 7 via a discriminating path 6. The discriminated bills are guided into a common route 9 by a first fork 8. Bills discriminated as genuine at the discriminating section 7 are guided by a second fork 10 into an accumulating route 11. Bills discriminated as spurious are guided into a rejection route 12. The genuine bills on the accumulating route 11 are continuously fed via a temporary pooling and accumulation wheel 14 of a bill delivering apparatus 13 to a bill supporting plate 16 of a bill accumulating and transferring mechanism 15, and the counterfeit bills on the rejection route 12 are fed to a rejection port 17.

The bills accumulated on the bill supporting plate 16 are transferred to a position above the bill receiving and dispensing port 4 and dropped thereon. The bills dropped onto the port 4 are then transferred to the discriminating path 6 through the received-bill feed apparatus 5 with the bills pressed down by a bill pressing-down apparatus (not shown). The bills discriminated as 10,000 yen bills at the discriminating section 7 are guided into a bill receiving route 18 by the first fork 8 and then fed into a circulating-bill pooling section 21 by a third fork 19 via a circulating-bill accumulation wheel 20. Bills other than 10,000 yen bills are guided into a received-bill containing apparatus 22 by the third fork 19 and are housed in a received-bill box 24 via an accumulation wheel 23.

When a person selects the bill dispensation designation, the 10,000 yen bills are fed to a bill dispensing route 26 from the circulating-bill pooling section 21 by a circulating-bill feeding-out apparatus 25. Bills other than 10,000 yen bills, for example, 1,000 yen bills or 5,000 yen bills, are placed beforehand in a dispensation bill containing apparatus (a bill containing box apparatus) 27 and fed by a dispensation bill feeding-out apparatus 28 to the bill dispensing route 26. During these operations, abnormalities are checked for, such as for example whether the bills to be dispensed are doubled over. When any such abnormality is detected, such bills are routed back to the received-bill box 24 of the received-bill containing apparatus 22 via a fourth fork 29, the received-bill route 18 and the third fork 19. If there is no abnormality, the bills are guided to the common route 9 by the fourth fork 29 and then guided by the second fork 10 to the accumulating route 11. The bills on the accumulating route 11 are then continuously accumulated on the bill supporting plate 16 of the accumulating and transferring mechanism 15 by the bill temporary pooling and accumulation wheel 14. Finally, the shutter 3 can be opened to allow the bills to be removed from the port 4.

Figure 1:
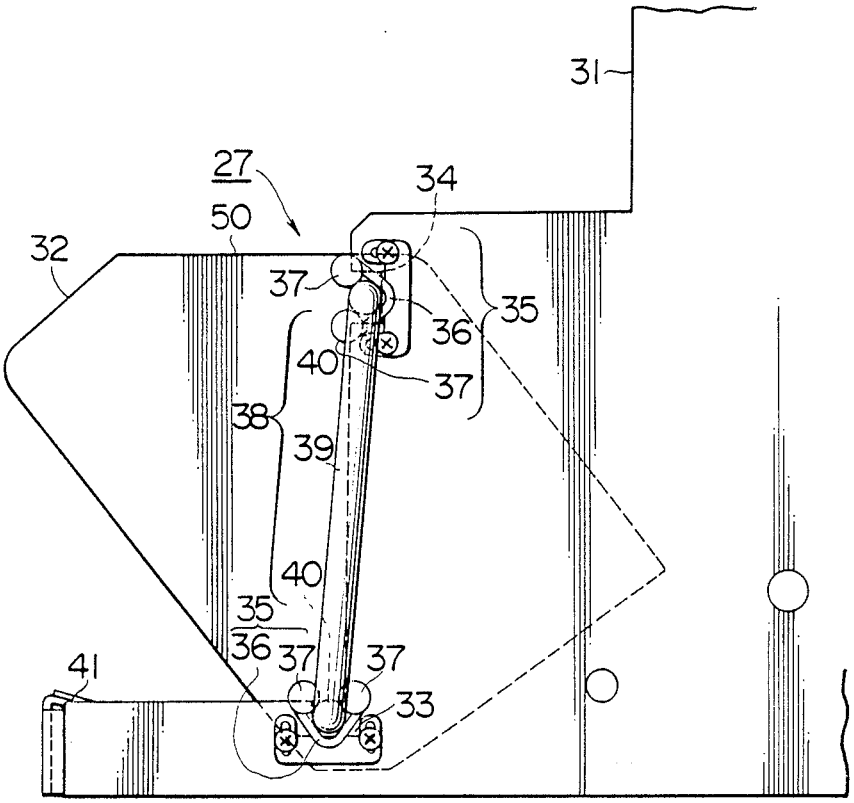
FIG. 1 is a side elevational view of the dispensation bill containing apparatus.
Figure 2:
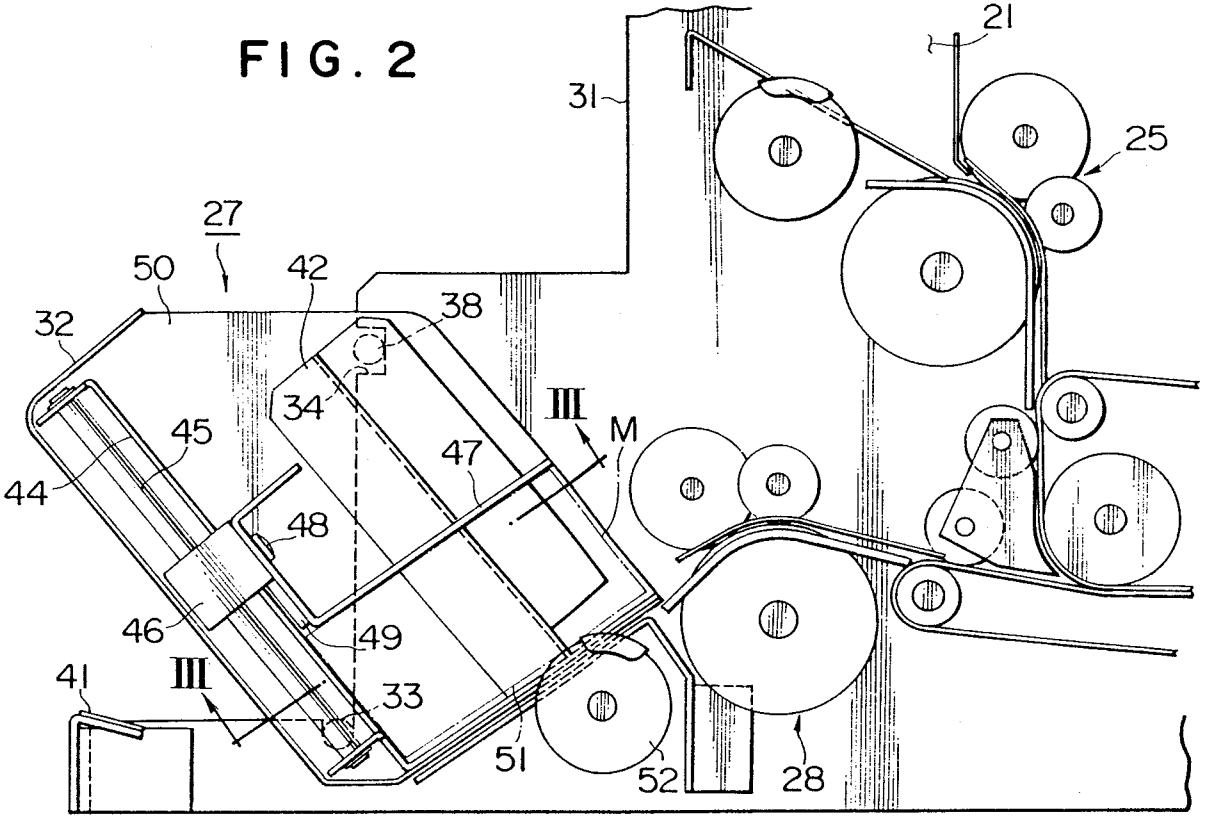
FIG. 2 is a side elevational view showing the inside structure of the dispensation bill containing apparatus.
Figure 3:
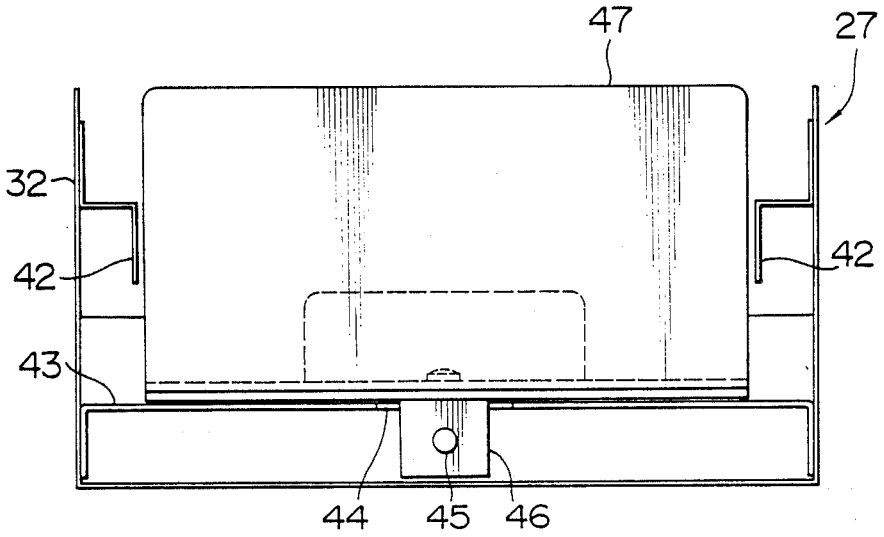
FIG. 3 is a view taken along a line III—III of FIG. 2.

Details of the bill containing box apparatus (the dispensation bill containing apparatus) 27 of the present invention will be described below with reference to FIGS. 1 to 3.

The bill containing box apparatus 27 comprises a pair of frame members 31 mounted on the machine body 1 behind a front door 30 (FIG. 4), the frame members being positioned spaced apart from each other at the right and left sides within the machine body 1, and a bill containing box 32 for housing the bills (e.g. 10,000 yen bills in this embodiment) to be dispensed. The bill containing box 32 has an upper opening 50 through which the bills are inserted and removed and a bottom opening 51 through which the bills are fed to the dispensation bill feeding-out apparatus 28.

Each of the frame members 31 is formed with a lower notch 33 facing upward to form a pivot for the bill containing box 32 as hereinafter explained in detail, and is also formed with an upper notch 34. Each of the lower and upper notches 33 and 34 is provided with a joint member 35 for detachably mounting the box 32. The joint member 35 comprises a spring 36 secured to the frame member 31 and head members 37 each of which is secured to the ends of the spring 36.

The bill containing box 32 is provided with engaging members 38 for permitting a snap engagement of the box 32 with the lower and the upper notches 33 and 34 via the spring 36 and the head members 37. Each of the engaging members 38 comprises a lever 39 which can also be used as a handle of the box 32 and a shaft 40 which is projected from the sides of the box 32 to secure the lever 39 thereto and is adapted to be snapped into the lower and upper notches 33 and 34 via the joint member 35, i.e. the spring 36 and the head members 37. When the bill containing box 32 is held by the notches 33 and 34 with the shafts 40 of the engaging members 38 snapped thereto as shown in FIGS. 1 and 2, the box 32 is in an inclined position so that the center of gravity is at the right hand side (FIGS. 1 and 2) from the plumb line through the lower notch 33 so as to stably hold the box 32 by a turning moment clockwise around the pivotal center (lower notches 33). As shown in FIGS. 1 and 2, when the box 32 is held within the machine body 1, the bottom opening 51 is positioned obliquely lower relative to the upper opening 50 so as to contain the bills in an inclined stacked condition within the box 32. The bill containing box 32 can be held in a substantially horizontal condition by pulling out the box 32 forward around the lower pivotal center 33 until the bottom wall of the box 32 abuts against a stop 41 secured to the frame members 31 by releasing the upper shafts 40 from the upper joint members 35. The bill containing box 32 can be also separated from the frame members 31 by releasing both the upper and lower shafts 40 of the box 32 from the upper and lower joint members 35 of the frame members 31.

The inside structure of the bill containing box 32 will now be described with reference to FIG. 3. Within the box 32 there are provided a pair of side support members 42 projecting from the right and left walls of the box 32 for preventing lateral movement of the stacked bills contained within the box 32, a bottom plate 43 for sliding the stacked bills in an inclined condition toward the dispensation bill feeding-out apparatus 28, a groove 44 formed substantially at the center of the bottom plae 43, a sliding block 46 supported by a guide rod 45 passing through the bottom plate 43 within the groove 44, and a pressure plate 47 mounted on the sliding block 46 for pressing down by its own weight the contained bills "M" (shown by a phantom line in FIG. 2) toward a feeding-out roller 52 of the dispensation bill feeding-out apparatus 28. A numeral 48 denotes a screw for securing the pressure plate 47 to the sliding block 46 and a numeral 49 denotes a spacer for enabling a smooth sliding motion of the pressure plate 47.

The other components will now be described.

The dealing port 2 includes a bill suppporting plate **4*a* descending from the shutter 3 and a vertical plate 4*b* forming the bill receiving and dispensing port 4. A feedingout port 4*c* is formed between the plates 4*a* and 4*b***.

The discriminating route 6 is positioned behind the received-bill feeding-out mechanism 5 via a bill introduction portion 54. The discriminating route 6 discriminates genuine bills and the type of bill and counts the number of bills transferred one by one between the belts 53A, 53B.

The received-bill route 18 comprises the lower transferring belt 53A forming the discriminating route 6 and another transferring belt 54 opposed to the lower belt 53A. The bills are held between these belts 53A and 54 and transferred reversely to the discriminating route 6 and then fed out either to the circulating-bill pooling section 21 or to the received-bill containing apparatus 22 by the third fork 19.

Then, dispensation operation of 1,000 yen bills and 10,000 yen bills, the charging of the bills in the bill containing box apparatus and the bill recovery operation will now be described.

With respect to the dispensation operation of 1,000 yen bills, the 1,000 yen bills are charged beforehand into the bill containing box 32. When an order to dispense 1,000 yen bills is made, the dispensation bill feeding-out apparatus 28 starts and the feeding-out roller 52 forming a part of the dispensation bill feeding-out apparatus 28 feeds out the bottom bill through the bottom opening of the bill containing box 32, toward the upper right in FIG. 2. Thus, the bills are fed out to the bill dispensing route 26 and transferred along this route 26 as previously described. During this time a check is made for any abnormality such as double-feeding. When any abnormality is found, the bills concerned are returned to the received-bill box 24 of the received-bill containing apparatus 22 via the fourth fork 29, the bill receiving route 18 and the third fork 19. When no abnormality is found, the bills are guided to the common route 9 by the fourth fork 29 and then guided by the second fork 10 to the accumulating route 11. The bills on the accumulating route 11 are then continuously accumulated on the bill supporting plate 16 of the accumulating and transferring mechanism 15 by the bill temporary pooling and accumulating wheel 14. Finally, the shutter 3 is opened to permit the user to take out the bills from the port 4.

When an order for dispensing 10,000 yen bills is made by the user, the 10,000 yen bills are fed out to the bill dispensing route 26 from the circulating-bill pooling section 21 via the circulating-bill feeding-out apparatus 25 and then are fed out to the bill receiving and dispensing port 4 similarly to the above dispensation operation for 1,000 yen bills. Dispensing of both 1,000 yen and 10,000 yen bills can be done by combining the dispensation operations of 1,000 yen and 10,000 yen bills.

To charge bills, the front door 30 is opened, exposing the front side of the received-bill containing apparatus 22 and the dispensation bill containing apparatus 27. In this condition, the bill containing box 32 can be tilted toward the front by pulling out the lever 39 and disengaging the upper shafts 40 of the engaging members 38 from the springs 36 and their head members 37 of the upper notches 34. The bill containing box 32 pivots around the joint members 35 of the lower notches 33 until the bottom of the box 32 abuts the stop 41 and is held in a substantially horizontal condition. In this condition, the 1,000 yen bills can be loaded through the upper opening 50 of the box 32 which is now exposed to the outside of the machine body 1. The bill containing box 32 can be also separated from the machine body 1, by further disengaging the lower shafts 40 from the joint members 35 of the lower notches 33. Thus it is possible to carry out the charging operation of the 1,000 yen bills at a convenient place.

After charging of the 1,000 yen bills, the bill containing box 32 is reset in the machine body 1 by reengaging the shafts 40 with the joint members 35, and the charging operation of the 1,000 yen bills is completed by closing the front door 30.

10,000 yen bills can be directly charged to the circulating-bill pooling section 21 by opening the front door 30 when the received-bill accumulating wheel 23 and the received-bill box 24 are mounted on the front door 30. It is also possible to charge the 10,000 yen bills through the bill receiving and dispensing port 2. In such a case, it is also possible to count the number of the 10,000 yen bills.

Regarding bill recovery, the amount of bills other than 10,000 yen bills are detected by a sensor (not shown). When the sensor detects that the amount of the bills other than 10,000 yen bills contained in the received-bill containing apparatus 22 exceeds the upper limit, the front door 30 is opened to remove the received-bill box 24 from the machine body 1 to recover the bills from the received-bill containing apparatus.

The operation of recovering bills such as 10,000 yen bills contained in the circulating-bill pooling section 21 and 1,000 yen bills contained in the received-bill containing apparatus 27 can be done by utilizing the bill recovering function of the bill receiving and dispensing machine itself. In the case of 10,000 yen bill recovery, the bill recovering operation is carried out by feeding out the bills in the circulating-bill pooling section 21 to the bill dispensing route 26 via the circulating-bill feeding-out apparatus 25 and then introducing the bills to the received-bill route 18 via the fourth fork 29, and feeding out the bills to the received-bill accumulating wheel 23 by the third fork 19 and finally housing them in the received-bill box 24. Thus, the 10,000 yen bills contained in the received-bill box 24 can be recovered together with the box 24.

Similarly, the 1,000 yen bills can be recovered in the received-bill box 24 by introducing them to the bill dispensing route 26 via the dispensation bill feeding-out apparatus 28. The 1,000 yen bills can also be recovered by opening the front door 30 and separating the bill containing box 32 from the machine body 1.

Since the inside of the machine body 1 is easily exposed by opening the front door 30, inspection or maintenance servicing can also be carried out from the front of the machine body 1 during these bill charging and recovering operations or at any other appropriate time.

The preferred embodiment described above may be modified as follows.

(i) The desired type of bill pooled in the circulating-bill pooling section may be selected.

(ii) The number of the circulating-bill pooling sections may be increased.

The bill receiving and dispensing machine of the present invention has the following effects.

(1) Since the bill containing box is supported by the frame members arranged at the front inside of the machine body, it is possible to easily carry out the inspection, charge and recovery operations of bills by merely opening the front door and exposing the bill containing box.

(2) Since the bill containing box can be tilted toward the front or separated from the machine body, it is possible to improve the handling of the bill containing box itself and the bills.

(3) Since the bill containing box is held in an inclined condition within the machine body and thus the bills are stacked in an inclined condition within the bill containing box, the bills can be smoothly introduced to the dispensation bill feeding-out apparatus by the action of gravity and the mechanism can be thus simplified.

What we claim is:

1. A bill receiving and dispensing machine for receiving and dispensing bills, said machine comprising:

a machine body, a front door forming a part of said machine body, a bill containing box of a substantially rectangular configuration normally carried obliquely in said machine body adjacent to said front door and said box being swingable in said machine body and removable from said machine body and bills stacked in said box are normally inclined, a pair of frame members disposed at opposite sides of said bill containing box, a pair of lower notches formed in said frame members and facing upward, a pair of upper notches formed in said frame members and facing the front of said machine body, an upper opening formed on said bill containing box and oriented upwardly for receiving and removing bills therefrom, a bottom opening formed on a bottom end of said bill containing box and normally oriented obliquely downwardly for communicating with a dispensation bill feed-out apparatus which feeds bills out of said bill containing box, and a pair of engaging members mounted on opposite sides of said bill containing box, said pair of engaging members including upper engaging portions extending horizontally for engaging with said upper notches, handle portions extending from said upper engaging portions for carrying said bill containing box and through which said bill containing box can be removed from said machine body, and lower engaging portions extending horizontally from said handle portions for engaging with said lower notches.

2. A bill receiving and dispensing machine in accordance with claim 1, wherein said upper and lower notches are provided with springs and head members for permitting snap engagement with said engaging members.

3. A bill receiving and dispensing machine in accordance with claim 1, wherein said bill containing box can swing around said lower engaging portions of said engaging members to be placed outside of said machine body when said upper engaging portions of said engaging members are disengaged from said upper notches.

4. A bill receiving and dispensing machine in accordance with claim 1, wherein said bill containing box can be removed from said machine box when both said upper and lower engaging portions of said engaging members are disengaged from said upper and lower notches respectively.

5. A bill receiving and dispensing machine in accordance with claim 1, wherein a center of gravity of said bill containing box is located at an opposite side of said front door with regard to a position of said lower engaging portions of said engaging members as a pivotal center for a swinging movement of said bill containing box.

* * * * *